United States Patent [19]

Ishida et al.

[11] 4,220,699

[45] Sep. 2, 1980

[54] METHOD FOR PRODUCING A LARGE NUMBER OF COPIES BY MEANS OF COPYING APPARATUS

[75] Inventors: Tsutomu Ishida, Tokyo; Takehiko Iwaoka, Yokohama, both of Japan

[73] Assignee: Ricoh Co., Ltd., Japan

[21] Appl. No.: 906,741

[22] Filed: May 17, 1978

[30] Foreign Application Priority Data

Jun. 3, 1977 [JP] Japan ..... 5264635

[51] Int. Cl.[2] ..... G03G 13/16; G03G 15/16

[52] U.S. Cl. ..... 430/126; 118/653; 355/3 TR; 427/24; 101/426; 101/DIG. 13; 430/48

[58] Field of Search ..... 96/1.4; 101/426; 427/24

[56] References Cited

U.S. PATENT DOCUMENTS

| | | | |
|---|---|---|---|
| 3,262,806 | 7/1966 | Gourge | 101/DIG. 13 |
| 3,326,709 | 6/1967 | Nail | 101/DIG. 13 |
| 3,363,555 | 1/1968 | Olden | 101/426 |
| 3,873,310 | 3/1975 | Bean | 96/1.4 |
| 3,961,951 | 6/1976 | Mayer et al. | 96/1.4 |
| 4,071,361 | 1/1978 | Marushima | 96/1.4 |

*Primary Examiner*—Roland E. Martin, Jr.
*Attorney, Agent, or Firm*—McGlew and Tuttle

[57] ABSTRACT

A method whereby a large number of copies can be produced from a single electrostatic latent image formed on one of a dielectric member, an insulating member or photoconductive member by developing and printing the image by transfer printing in successive operations. The absolute value of a bias voltage impressed on the developing device in developing the electrostatic latent image is gradually reduced until the number of copies produced reaches a specific level, and then progressively increased as the number of copies produced increases for producing copies in numbers which exceed the specific level, whereby copies of a number greater than the number of the specific level can be produced from the same electrostatic latent image.

7 Claims, 4 Drawing Figures

METHOD FOR PRODUCING A LARGE NUMBER OF COPIES BY MEANS OF COPYING APPARATUS

BACKGROUND OF THE INVENTION

This invention relates to methods for producing copies by means of a copying apparatus, and more particularly to a method for producing a large number of copies from a single electrostatic latent image formed on an electrostatic image bearing member, e.g. a dielectric or an insulating member or a photoconductive member, by adhering a toner to the electrostatic image to develop the same into a visible image and printing the visible image on a recording sheet by transfer printing in successive operations whereby a large number of copies can be produced from the same electrostatic latent image.

In copying methods of the prior art, it has hitherto been customary to first uniformly subject, to corona charging, the surface of a photoconductive member formed mainly by a coat of selenium, zinc oxide, polyvinyl carbazole or trinitrofluorenone, and then the charged surface of the photoconductive member is exposed to an optical image of an original to be copied. Alternatively, a dielectric film or an insulating film such as a sheet of Mylar (trade name), is subjected at its surface to a discharge from needle electrodes in a pattern corresponding to an image to be formed. Thus an electrostatic latent image is formed on a photoconductive member or a dielectric member or an insulating member and is developed into a visible image which in turn is printed on a recording sheet by transfer printing so as to produce a copy of the original. After being developed, the electrostatic latent image is erased by exposing the image in its entirety to light or bringing the image into contact with a conductor which is grounded, and the residual toner is wiped away, if necessary. The aforementioned process steps are followed in the same manner irrespective of the number of copies to be produced, and an electrostatic latent image is formed and erased each time a copying operation is performed.

When it is desired to produce a plurality of copies from a single original, it is not necessary to carry out repeatedly a series of process steps of forming an electrostatic image, developing the electrostatic image into a visible image, printing the visible image by transfer printing on a recording sheet and cleaning the image bearing member. More specifically, it is known to produce a plurality of copies at high copying speed by merely carrying out the developing and printing steps after an electrostatic image is once formed. If this method is used, then it is possible to increase the reliability of a copying apparatus in performance, because a strain on the image bearing member, exposure light source and cleaning device can be lessened.

In the aforementioned type of copying method of producing a plurality of copies, it is, of course, desirable that the number of copies that can be produced from a single electrostatic image be maximized. However, limitations are placed on the number of copies that can be produced from a single electrostatic image by the facts that the charge carried by an electrostatic image is reduced with time, and that the charge leaks when the electrostatic image is developed and printed on a recording sheet by transfer printing. Particularly, it has been ascertained by us that the leakage of the charge carried by an electrostatic image is great when the electrostatic image is brought into contact with a developing agent in the developing station. In a dual-component developing method, a developing agent consists of a toner and a carrier. If the carrier, which plays the role of causing, by friction, the toner to carry opposite charge to the electrostatic image and of conveying the toner to the electrostatic image, is electrically conductive, the charge carried by the electrostatic image tends to be conducted to the ground through the carrier. Thus it is essentially impossible to use the same electrostatic image for producing a plurality of copies. Therefore, it is necessary that the carrier used be electrically insulated and this is also known.

In a magnetic brush developing method, for example, the carrier used is perferably in the form of ferrite powder or iron powder coated with a resinous material. In a cascade developing method, the carriers which are preferred include glass beads and resin beads, in addition to the aforementioned types of carriers. However, the use of an electrically insulated carrier is not enough to prevent the leakage of charge from the electrostatic image. Even if an electrically insulated carrier is used, the charge carried by the electrostatic image is considerably reduced when the number of copies produced is increased. Thus it is still impossible to produce a relatively large number of copies from a single electrostatic image by using any of the carriers treated to become electrically insulated.

Proposals have hitherto been made to use an advantageous copying method for the purpose of producing a large number of copies from a single electrostatic image by obviating the aforementioned disadvantages of the prior art. More specifically, it has been proposed to impress a bias voltage of the same polarity as the charge carried by the electrostatic image on the developing sleeve or electrode plate, for example, of the developing device for developing the electrostatic latent image into a visible image, so as to minimize the adhesion of the toner to the non-image areas of the electrostatic image bearing member. In this method, the bias voltage is reduced in value in accordance with the surface potential of the non-image areas of the electrostatic image bearing member, as the number of copies produced is increased, thereby avoiding a reduction in the density of the image areas of the electrostatic image bearing member which would otherwise occur due to an increase in the number of copies produced. The aforementioned method is advantageous because it enables the number of copies produced from a single electrostatic image to be considerably increased. However, the results of experiments conducted by us show that the number of copies produced by this method is still too small to be of any practical value in actual practice. It is only about twenty copies that can be produced by this method.

SUMMARY OF THE INVENTION

This invention has as its object the provision of a method for producing a large number of copies by means of a copying apparatus which method is capable of increasing the number of copies produced from a single electrostatic latent image by the aforesaid method of the prior art.

The present invention is based on the discovery that, in methods of producing a large number of copies by using a dual-component developing method, the number of copies produced from a single electrostatic latent image is governed not only by the property of the carrier alone or the relative properties of the carrier and toner but also by the electrical relation between the dielectric or insulating member or photoconductive member bearing an electrostatic image and the carrier.

According to the invention, there is provided a method for producing a large number of copies from a single electrostatic latent image by means of a copying apparatus, comprising the steps of forming an electrostatic latent image on an electrostatic image bearing member, developing the electrostatic latent image into a visible image by using a developing agent including a toner and a carrier, and printing the visible image on a copy sheet by transfer printing, wherein said process steps are repeatedly carried out a plurality of times and the carrier of the developing agent has the property of being electrically insulated for reducing the leakage of the charge carried by the electrostatic latent image, while a bias voltage of the same polarity as the electrostatic latent image is impressed on a developing device at least during a developing operation, such method further comprising the steps of selecting materials for the electrostatic image bearing member and the carrier of the developing agent in such a manner that, with an increase in the number of copies produced, the absolute value of the surface potential of non-image areas of the electrostatic image bearing member first falls and then gradually rises, and changing the value of the bias voltage impressed on the developing device substantially in accordance with changes in the surface potential of the non-image areas of the electrostatic image bearing member with an increase in the number of copies produced.

In the present invention, the value of a bias voltage impressed on the developing device when a developing operation is performed is gradually reduced until the number of copies produced reaches a certain specific level, and thereafter the value of the bias voltage is increased as the number of copies produced increase above the specific level, so that a number of copies can be produced from a single electrostatic latent image in numbers which is greater than the specific number of copies.

Additionally other objects as well as features and advantages of the invention will become apparent from the description set forth hereinafter when considered in conjunction with the accompanying drawings.

DETAILED DESCRIPTION OF THE PREFERRED EMBODIMENTS

Figure 1:
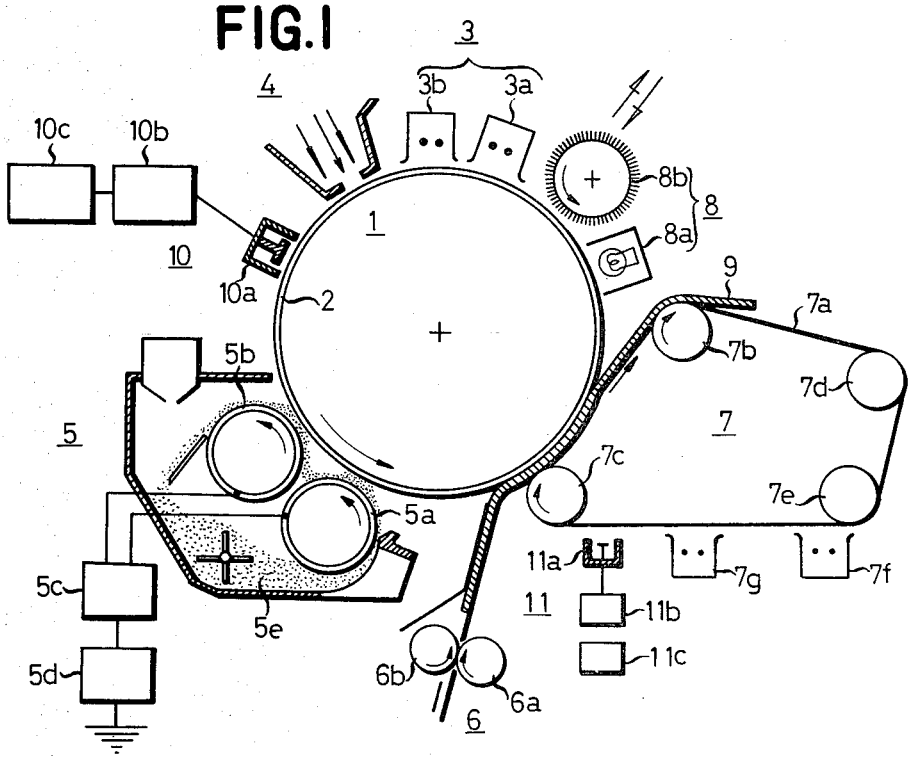
FIG. 1 is a schematic sectional view of one example of the electrophotographic copying apparatus adapted to carry the method, according to the invention, into practice.

FIG. 1 shows one example of the electrophotographic copying apparatus which is adapted to carry the method according to the invention into practice. To enable the invention to be thoroughly understood, the construction of the copying apparatus shown in FIG. 1 and a copying method of the prior art adapted in producing copies by using the apparatus shown in FIG. 1 will be outlined and the experiments conducted by us will be described, prior to describing the advantageous method provided by the invention.

In FIG. 1, the numeral 2 designates a photoconductive member coated on the outer periphery of a drum 1 made of aluminum, for example. The photoconductive member 2 has its surface charged uniformly by a charging device 3 including corona chargers 3*a*, 3*b*, and is exposed to an optical image of an original in an exposure station 4 so that an electrostatic latent image will be formed thereon. The photoconductive member 2 thus exposed passes successively through a developing device 5 and a transfer printing device 7 to form a toner image on a copy sheet 9, which toner image is heated and fixed by a fixing device, not shown, so that a desired copy of the original can be produced.

The electrostatic image on the photoconductive member 2 is not erased and subjected successively to developing and transfer printing to produce a plurality of copies. Upon completion of the production of copies of a desired number, the photoconductive member 2 has its entire surface exposed to light emanating from an exposing means 8*a* in a cleaning station 8 where residual toner is removed from the photoconductive member 2 by means of a toner removing brush 8*b*, so that the photoconductive member 2 is restored to its original condition.

The developing device 5 for developing the electrostatic latent image into a visible image includes developing sleeves 5*a* and 5*b* having permanent magnets, not shown, which are rotated to scoop up a developing agent 5*e* and bring the same into contact with the electrostatic latent image on the photoconductive member 2. The developing agent 5*e* is a dual-component developing agent consisting of a toner and a carrier. The developing sleeves 5*a* and 5*b* have a bias voltage impressed thereon from a direct current source 5*d* through a controller 5*c*. The impression of a bias voltage is carried out for the purpose of minimizing the quantity of toner adhering to non-image areas of the photoconductive member 2 as subsequently to be described.

In the transfer printing device 7, an endless belt 7*a* including a layer of about 100μ in thickness made of Teflon (trade name), for example, and a backing layer of electrically conductive rubber is trained over pulleys 7*b*, 7*c*, 7*d* and 7*e*, and has its surface uniformly charged by means of a charger 7*g* so that the surface of the belt 7*a* will carry a charge of opposite polarity to the charge carried by the toner. A copy sheet 9 fed from a sheet feeding device 6 having sheet feeding rollers 6*a*, 6*b* is passed between the drum 1 and the belt 7*a* in such a manner that the underside of the copy sheet 9 is brought into contact with the photoconductive member 2 formed with a toner image thereon, to thereby print the toner image on the copy sheet 9 by transfer printing. The charge carried by the belt 7*a* is erased by means of a corona charge remover 7*f*.

By using the apparatus constructed as aforementioned, we have conducted experiments on the production of a large number of copies by using a copying method of the prior art. A layer of selenium of a thickness of 25μ formed on the drum 1 by vaporization deposition in vacua was used as a photoconductive member. The toner used was a toner for PPC 900 (made by Ricoh Company), and the carrier used consisted of iron beads of 150μ in diameter each having on its surface a coat of styrene methyl methacrylate resin of 1.5μ in thickness. In the experiments, the surface potential of the belt *7a* was adjusted to 1300 volts immediately before being put into operation for transfer printing, by measuring the potential by a transfer printing potential detecting means 11 including a detecting head 11*a*, a detecting circuit 11*b* and a recorder 11*c*. The bias voltage impressed on the developing sleeves 5*a*, 5*b* was set at 200 volts, and was kept at the same level in spite of an increase in the number of copies produced. The copies produced by this method were reduced in the density of the image as the number of copies produced from the same electrostatic image increased, and the number of copies that could be put to practical use was about 12 or 13, although the background of the printed image of each copy was free from smudges.

Figure 3:
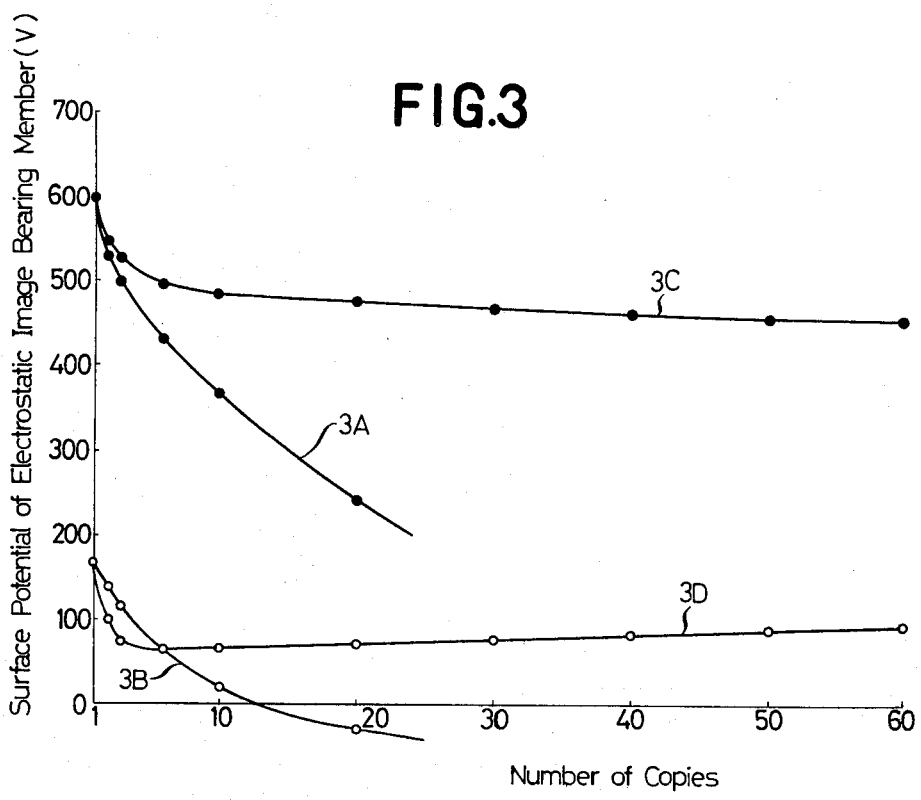
FIG. 3 is graph showing the relationship between the number of copies produced by means of an electrophotographic copying apparatus and the surface potential of an electrostatic image bearing member.

In FIG. 3, curves 3A and 3B represent the values of the surface potential, which are obtained in abovementioned experiments in different areas of the photoconductive member. The curve 3A represents the values of the surface potential, measured when copies were produced successively, of image areas of the photoconductive member which correspond to the image areas of an original. The curve 3A indicates the surface potential of the electrostatic image. The curve 3B represents the surface potential of non-image areas of the photoconductive member which correspond to the non-image areas or background of the original. The potentials of the photoconductive member were measured by using an electrostatic image potential measuring means 10 including a measuring head 10*a*, an electrometer 10*b* and a recorder 10*c*, immediately before the photoconductive member formed with the electrostatic latent image was introduced into the developing device 5 for successively producing copies.

The curves 3A and 3B will now be discussed. Generally, the toner tends to adhere to the non-image areas of the photoconductive member due to the potential of the non-image areas as indicated by the curve 3B, with a result that the copies produced have smudges on their non-image areas. In order to prevent this phenomenon, a bias voltage is impressed on the developing sleeves 5*a*, 5*b* as aforementioned. Therefore, the bias voltage is of the same polarity as the electrostatic charge on the electrostatic image. When the values of the potential of the image areas of the photoconductive member are as indicated by the curve 3A, the bias voltage has a value which is usually about 200 volts as aforementioned. It is for the purpose of preventing adhesion of the toner to the non-image areas of the photoconductive member as is known that the bias voltage has a higher value than the initial surface potential of the non-image areas of the photoconductive member as indicated by the curve 3B. In actual practice, the potential which contributes to the developing of the electrostatic image is the difference Vd between each of the surface potentials of the image areas of the photoconductive member indicated by the curve 3A shown in FIG. 3 and the bias voltage. In the case of the surface potential of the image areas for producing a first copy as shown in FIG. 3A, it is not 600 volts but the voltage difference Vd which contributes to the developing of the electrostatic image. Thus, if the bias voltage is 200 volts, the voltage differential Vd will be 400 volts. Therefore, if the surface potential is gradually reduced with an increase in the number of copies produced as indicated by the curve 3A, the voltage differential Vd will also be reduced so long as the bias voltage is kept constant. The result of this is that the images of the copies produced will become gradually lower in density.

As described hereinabove, in another relatively advantageous copying method of the prior art, the values of the potential of the non-image areas of the photoconductive member are reduced with an increase in the number of copies produced as indicated by the curve 3B. Our attention was attracted by this fact, and attempts were made to reduce the values of the bias voltage in accordance with the reduction in value of the surface potential of the non-image areas of the photoconductive member, because we thought that a reduction in the voltage difference Vd could be minimized and the copies produced would have images of high density with little smudges in the non-image areas of the copies.

It is impossible to reduce the values of the bias voltage below the value of the potential of the non-image areas of the photoconductive member, so that the bias voltage was reduced in a curve substantially parallel to the curve 3B while the former were maintained at a slightly higher level than the latter. When the bias voltage was reduced below the surface potential of the non-image areas indicated by the curve 3B, the toner adhered to the non-image areas of the photoconductive member and the copies produced had smudges in the non-image areas thereof.

However, the reduction in the value of the potential of the non-image areas indicated by the curve 3B is smaller than the reduction in the value of the potential of the image areas indicated by the curve 3A. Thus even if the bias voltage was gradually reduced in value as aforementioned the voltage differential Vd between the surface potential of the image areas indicated by the curve 3A and the bias voltage gradually became smaller. After all, the range in which the voltage differential Vd has a sufficiently high value to enable satisfactory copies to be produced was restricted, and it was only about 20 copies of acceptable quality that was produced from a single electrostatic latent image.

In order to obviate the aforementioned disadvantages of the prior art, we have carried out experiments by using various materials for the photoconductive member and the carrier of the developing agent. The results of the experiments have disclosed the following fact.

The fact revealed is that if the surface layer of an electrostatic image bearing member (which is a photoconductive member in the embodiment shown in FIG. 1) and the carrier of a developing agent are formed of suitable materials, it is possible to maintain the surface potential of the image areas of the electrostatic image bearing member at a considerably high level (as indicated by a curve 3C in FIG. 3, for example) even after copies of a considerably large number have been produced. It has been also ascertained that when the aforementioned suitable materials are used as the surface layer of an electrostatic image bearing member and the carrier of a developing agent, the absolute value of the surface potential of the non-image areas of the electrostatic image bearing member first shows a reduction with an increase in the number of copies produced and then shows a gradual increase (as indicated by a curve 3D in FIG. 3).

The present invention is based on the aforementioned discovery, and a concrete example will be described in detail hereinafter. First of all, the experiments conducted by us will be described in which methyl methacrylate resin was used as a material for an electrostatic image bearing member which is capable of maintaining the values of the surface potential of the image areas thereof at a high level and styrene methyl methacrylate resin was used as a material for coating the surface of the carrier of the developing agent.

In carrying the method according to the invention into practice, the copying apparatus shown in FIG. 1 was used, and the drum 1 was coated with a selenium layer of 25μ in thickness as a photoconductive layer, and a layer of methyl methacrylate resin of 2μ in thickness was formed on the photoconductive layer. In forming the methyl methacrylate resin layer, the resin was dissolved in ethyl acetate and the selenium layer was dipped in the solution. As the carrier of a developing agent, iron beads were used by coating them with styrene methyl methacrylate resin in a thickness of 1.5μ, as used in the aforementioned experiments. Production of a large number of copies from a single electrostatic image was carried out under the aforesaid conditions, and the surface potential of the image areas of the electrostatic image bearing member was placed under observation. The results of the observation show that the potential of the image areas has a characteristic as indicated by the curve 3C in FIG. 3 and that the potential of the non-image areas has a characteristic as indicated by the curve 3D in FIG. 3. It will be seen that the potential of the non-image areas indicated by the curve 3D once falls in value as the number of copies produced increases but rises after 5 or 6 copies are produced. At the same time, the potential of the image areas indicated by the curve 3C shows little fall even if the copies produced increase in number. It should be noted that when the methyl methacrylate coating is provided on the photoconductive layer (selenium layer), a fall in the value of the surface potential of the image areas is markedly lower than when no methyl methacrylate coating is provided (see curve 3A).

Figure 4:
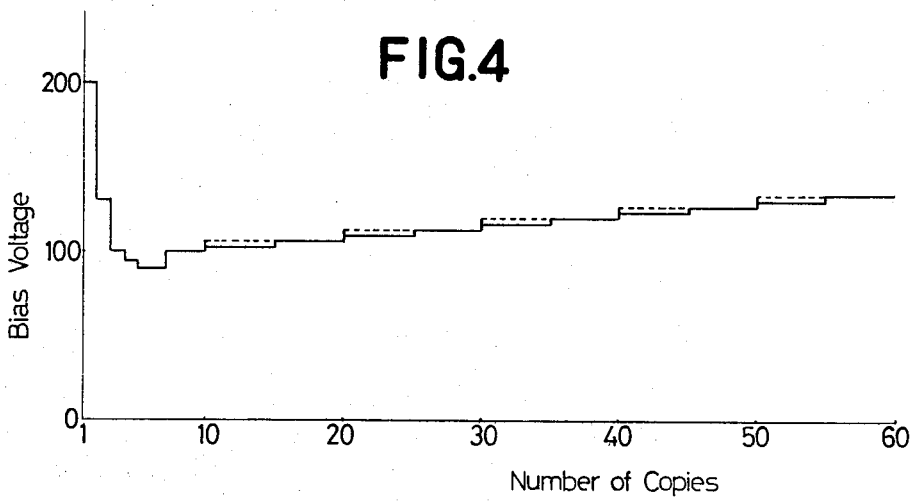
FIG. 4 is a graph showing the relationship between the number of copies produced by the method according to the invention and the value of the bias voltage.

In carrying out the production of a large number of copies from a single electrostatic image under the aforementioned conditions, the bias voltage impressed on the developing sleeves 5*a*, 5*b* was varied sequentially in value, as indicated by solid lines in FIG. 4, along the curve 3D in FIG. 3 while maintaining the values of the bias voltage at a level slightly higher than the values of the potential of the non-image areas (curve 3D). That is, by using the controller 5*c* shown in FIG. 1, the bias voltage was set at 200 volts for the first copy, successively reduced to 130, 100, 95 and 90 volts for the second to the fifth copy, kept at 90 volts for the sixth copy, raised to 100 volts for the seventh to the tenth copy, and finally raised by about 7 volts for each batch of 5 copies following the production of the first batch of 10 copies. By varying the values of the bias voltage impressed on the developing device 5, it was possible to produce over 60 copies which had images of high and constant density and which were free from smudges in the non-image areas. When the bias voltage was raised by 14 volts for each batch of 10 copies after printing the initial batch of 10 copies as indicated by broken lines in FIG. 4, substantially similar results were obtained.

Under the identical conditions, a plurality of copies were produced by using the aforementioned method of the prior art which was proposed as providing an improvement in methods for producing a large number of copies. To describe more in detail, the bias voltage impressed on the developing device 5 was gradually lowered from the initial level of 200 volts as the number of copies produced increased, and was not raised. As a result, the copies produced following the production of the first batch of 6 copies had smudges in the non-image areas although the images had high density. When the bias voltage was kept at the initial level of 200 volts and not varied with the progress of printing, there was a marked difference in the density of the images between the first copy and the copies produced thereafter, although there were no smudges in the non-image areas of the copies. The reasons why these phenomena have occured will be clear from the explanation set forth hereinabove.

From the foregoing description, it will be appreciated that if the carrier of the developing agent is coated with styrene methyl methacrylate resin and the photoconductive member is coated with methyl methacrylate resin in producing a plurality of copies from a single electrostatic image, the potential of the non-image areas of the photoconductive member shows a tendency to rise after a batch of about 10 copies has been produced and that the potential of the image-areas which form images on the copies when developed shows a markedly little reduction. Therefore, if the bias voltage impressed on the developing device is gradually reduced in value until the number of copies produced reaches a level at which the potential of the non-image areas shifts from a reduction to an increase, and thereafter gradually raised for one copy or a batch of several copies, over several scores of copies of high quality can be produced from a single electrostatic latent image.

It is not methyl methacrylate resin alone that exhibits the aforementioned characteristic with regard to the surface potential. There are many other substances which have the same characteristic. This is true not only of the type of copying apparatus shown in FIG. 1 but also of copying apparatus (electrostatic recording apparatus) which use a dielectric member or an insulating member as an electrostatic image bearing member. More specifically, when the carrier is coated with styrene methyl methacrylate resin as aforementioned, polyester resin, silicone resin, aniline resin or the like can be used, in addition to methyl methacrylate resin, as a material for coating the surface of the photoconductive member, such as a selenium layer, for forming an electrostatic image of positive charge thereon, or as a material for forming a dielectric member or an insulating member for recording a positive discharge pattern. When the carrier is coated with polyvinyl chloride, ethylene chloride resin can be used as a material for coating the surface of a photoconductive member, such as a polyvinyl carbazole-trinitro fluorenone layer, for forming an electrostatic image of negative charge thereon, or as a material for forming a dielectric member or an insulating member for recording a negative discharge pattern.

The aforementioned behavior of the surface potentials of the image areas and non-image areas of an electrostatic image bearing member, indicated by the curves 3C and 3D in FIG. 3, which is exhibited when the material used for forming an electrostatic image bearing member is selected relative to the material for coating the carrier as aforementioned could be accounted for by friction chargeability. When the friction charging system is considered, it will be apparent that the charge carried by an electrostatic image is hard to leak if the surface of a member bearing an electrostatic image of positive charge is more readily chargeable positively than the surface of a carrier, or if the surface of a member bearing an electrostatic image of negative charge is more readily chargeable negatively than the surface of a carrier. Thus when a large number of copies are to be produced from a single electrostatic image, the potential of the non-image areas of the electrostatic image bearing member shows a tendency to rise after first falling. It is considered likely that when the electrostatic image is positively charged, the positive charge carried by the electrostatic image bearing member shows little or no tendency to pass on to the carrier of the developing agent, if the electrostatic image bearing member is more readily chargeable positively than the carrier of the developing agent. The same is considered to be true of the case in which the charge carried by the electrostatic image is negative. The friction charging effect is produced as the developing agent is brought strongly into contact with the surface of the electrostatic latent image bearing member when developing of the electrostatic image is carried out, either by a magnet brush method or by a cascade method.

Accordingly, in the present invention, it is essential to use a combination of materials for coating the surface of the carrier of a developing agent and for coating the surface of an electrostatic image bearing member in such a manner that the potential of the non-image areas of the electrostatic image bearing member shows a tendency to rise even if it falls first, by virtue of the friction charging effect produced between the surface of the carrier and the surface of the electrostatic image bearing member. By using the aforementioned combination of materials, the bias voltage impressed on the developing device gradually falls in initial stages of a developing operation as the number of copies produced increases, and then gradually rises after the number of copies produced has reached a certain level. By following this method steps, it is possible to produce a large number of copies having printed images of high and constant density and free from smudges on non-image areas thereof from a single electrostatic image.

It is to be understood that the bias voltage has a different polarity depending on whether the charge carried by the electrostatic image is positive or negative. It will be apparent that the level of the bias voltage or its fall or rise refers to the absolute value thereof.

Figure 2:
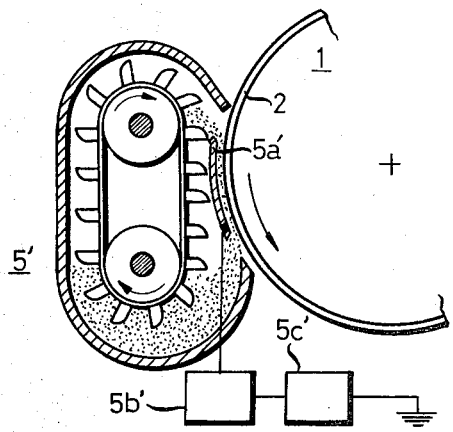
FIG. 2 is a schematic sectional view of the essential portions of an electrophotographic copying apparatus using a developing system differing from the developing system of the apparatus shown in FIG. 1, which is also adapted to carry the method, according to the invention, into practice.

In the description set forth hereinabove, the invention has been described mainly with reference to a magnet brush developing method. However, the method of the invention can be carried into practice when developing is carried out by means of a cascade developing method as shown in FIG. 2 in which a controlled bias voltage is impressed by a bias voltage impressing means including a controller 5b' and a direct current source 5c' on a developing electrode 5a' which is juxtaposed against an electrostatic image in a developing device 5'.

What is claimed is:

1. A method for producing a large number of copies from a single electrostatic latent image by means of a copying apparatus, comprising the steps of forming an electrostatic latent image on an electrostatic image bearing member, developing said electrostatic latent image into a visible image by using a developing agent comprising a toner and a carrier, and printing said visible image on a copy sheet by transfer printing, wherein said process steps are repeatedly carried out a plurality of times and the carrier of the developing agent has the property of being electrically insulated for reducing the leakage of the charge carried by the electrostatic latent image, while a bias voltage of the same polarity as the electrostatic latent image is impressed on a developing device at least during a developing operation, said method further comprising the steps of selecting materials for the surface of the electrostatic image bearing member and the carrier of the developing agent so that the electrostatic image bearing member is more easily electrostatically chargeable than the carrier and so that, with an increase in the number of copies produced, the absolute value of the surface potential of non-image agreas of the electrostatic image bearing member first falls and then gradually rises, and changing the values of the bias voltage impressed on the developing device substantially in accordance with changes in the surface potential of the non-image areas of the electrostatic image bearing member with an increase in the number of copies produced with the absolute value of the bias voltage impressed on the developing device being maintained at a level slightly higher than the absolute value of the surface potential of the non-image areas of the electrostatic image bearing member.

2. In a method for producing a number of copies from a single electrostatic image which includes forming a latent electrostatic image on an electrostatic image bearing member, developing the latent image into a visible image in a development station using a developing agent that includes a toner and a carrier, and printing said visible image on a copy sheet by transfer printing whereby the printing step is repeatedly carried out a plurality of times, the improvement of selecting the carrier of a developing agent having the property of being electrically insulated for reducing the leakage of the charge carried by the latent image, coating the surface of the image bearing member with a coating of material having the characteristic whereby the potential of the non-image areas of the image bearing member shows a tendency to first fall in printing the first few copies and then rises and whereby the potential of the image areas falls gradually and slightly and so that the image bearing member is more easily chargeable than the carrier of the developing agent, and impressing a bias voltage of the same polarity as the electrostatic latent image in the development stage which is gradually reduced until the number of copies printed reach a number at which the potential of the non-image area shifts from a reduction to an increase, the bias voltage being varied in accordance with the changes in the potential of the non-image area and maintained at a level slightly above the potential of the non-image area.

3. A method as defined in claim 2, wherein said image-bearing member is chosen from the group consisting of a photoconductive member, a dielectric member, and an electrically insulating member.

4. A method according to claim 2, wherein said image bearing member is made of a material chosen from the group consisting of selenium, zinc oxide, polyvinyl carbazole-trinitrofluorenone.

5. The method as defined in claim 2 including the step of coating the carrier of the developing agent with a layer of material selected from the group consisting of styrene methyl methacrylate resin, and polyvinyl chloride.

6. The method as defined in claim 2 and including the step of coating the image bearing member with a layer of material selected from the group consisting of methyl methacrylate resin, polyester resin, silicone resin, aniline resin, and ethylene chloride resin.

7. In a method for producing a relatively large number of copies from a single electrostatic image comprising the steps of forming a latent image bearing member with a coating with a surface material having the characteristics in that the surface potential of the non-image areas of the electrostatic latent image tends to rise after falling, forming an electrostatic latent image on said surface material, developing the latent image into a visible image by using a developing agent including a carrier and toner, wherein said carrier is coated with a material which coacts with the surface material of said image-bearing member whereby the image bearing member is more readily charged than the surface of the carrier during the development stage, and impressing a bias voltage having the same polarity as that of the latent image in a development stage whereby said bias voltage is first incrementally reduced in printing the first few copies and thereafter gradually increased as the number of copies which are produced increases, the bias voltage varying in accordance with but maintained slightly above the potential of said non-image area.

* * * * *